US009171510B2

(12) United States Patent
You et al.

(10) Patent No.: US 9,171,510 B2
(45) Date of Patent: Oct. 27, 2015

(54) METHOD AND APPARATUS FOR SETTING GAMMA REFERENCE VOLTAGE, DRIVING CIRCUIT AND DISPLAY APPARATUS

(71) Applicant: BOE TECHNOLOGY GROUP CO., LTD., Beijing (CN)

(72) Inventors: Jaegeon You, Beijing (CN); Chang Xie, Beijing (CN); Xin Gu, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 133 days.

(21) Appl. No.: 14/128,733

(22) PCT Filed: Dec. 5, 2012

(86) PCT No.: PCT/CN2012/085984

§ 371 (c)(1),
(2) Date: Dec. 23, 2013

(87) PCT Pub. No.: WO2013/177911

PCT Pub. Date: Dec. 5, 2013

(65) Prior Publication Data

US 2014/0146096 A1 May 29, 2014

(30) Foreign Application Priority Data

May 31, 2012 (CN) ..... 2012 1 0177715

(51) Int. Cl.
*G09G 3/36* (2006.01)
*G09G 3/00* (2006.01)

(52) U.S. Cl.
CPC ..... *G09G 3/3607* (2013.01); *G09G 3/006* (2013.01); *G09G 3/3611* (2013.01);

(Continued)

(58) Field of Classification Search
CPC . G09G 3/3607; G09G 3/3614; G09G 3/3696; G09G 3/3648; G09G 3/3611; G09G 3/3685; G09G 3/3688; G09G 3/006; G09G 2320/0276; G09G 2320/0257; G09G 2320/0247; G09G 2320/0233; G09G 2320/0219; G09G 2320/0204; G09G 2320/0673; G09G 2310/027
See application file for complete search history.

(56) References Cited

U.S. PATENT DOCUMENTS 6,831,620 B1 * 12/2004 Nishikubo et al. ..... 345/87
7,417,612 B2 * 8/2008 Lee et al. ..... 345/89

(Continued)

FOREIGN PATENT DOCUMENTS

CN 1539135 A 10/2004
CN 1841450 A 10/2006

(Continued)

OTHER PUBLICATIONS

Rejection Decision issued by the Chinese Patent Office for Chinese Patent Application No. 201210177715.5 dated Jul. 30, 2014, 6pgs.

(Continued)

*Primary Examiner* — Dwayne Bost
*Assistant Examiner* — Darlene M Ritchie

(57) ABSTRACT

A method and an apparatus for setting a gamma reference voltage, and a driving circuit are provided, which decrease a driving voltage of a display apparatus and reduce power consumption by resetting the gamma reference voltage of the display apparatus. The method comprises: acquiring a dielectric constant of a liquid crystal capacitor according to a first gamma reference voltage (101); acquiring a value of the liquid crystal capacitor according to the dielectric constant of the liquid crystal capacitor (102); acquiring a feedback voltage according to the value of the liquid crystal capacitor, acquiring a second gamma reference voltage according to the feedback voltage, and updating the first gamma reference voltage to the second gamma reference voltage (103). The method and apparatus for setting a gamma reference voltage, and the driving circuit may be applied to production and manufacture of a liquid crystal display.

12 Claims, 5 Drawing Sheets

(52) U.S. Cl.
CPC ..... *G09G 3/3688* (2013.01); *G09G 3/3696* (2013.01); *G09G 2320/0204* (2013.01); *G09G 2320/0219* (2013.01); *G09G 2320/0247* (2013.01); *G09G 2320/0257* (2013.01); *G09G 2320/0276* (2013.01); *G09G 2320/0673* (2013.01)

(56) References Cited

U.S. PATENT DOCUMENTS

| | | | | |
|---|---|---|---|---|
| 8,068,086 | B2 * | 11/2011 | Moon | 345/101 |
| 8,106,862 | B2 * | 1/2012 | Miyata | 345/87 |
| 8,614,721 | B2 * | 12/2013 | Nakanishi et al. | 345/690 |
| 2003/0098839 | A1 * | 5/2003 | Lee | 345/89 |
| 2006/0187160 | A1 * | 8/2006 | Lai | 345/88 |
| 2008/0218463 | A1 * | 9/2008 | Lee et al. | 345/89 |
| 2008/0278470 | A1 * | 11/2008 | Im et al. | 345/211 |
| 2012/0320019 | A1 * | 12/2012 | Jeong et al. | 345/211 |

FOREIGN PATENT DOCUMENTS

| | | | |
|---|---|---|---|
| CN | 101022005 | A | 8/2007 |
| CN | 102708825 | A | 10/2012 |
| TW | 523731 | B | 3/2003 |

OTHER PUBLICATIONS

English translation of Rejection Decision issued by the Chinese Patent Office for Chinese Patent Application No. 201210177715.5 dated Jul. 30, 2014, 7pgs.

First Office Action issued by the Chinese Patent Office for Chinese Patent Application No. 201210177715.5 dated Jul. 29, 2013, 7pgs.

English translation of First Office Action issued by the Chinese Patent Office for Chinese Patent Application No. 201210177715.5 dated Jul. 29, 2013, 8pgs.

Second Office Action issued by the Chinese Patent Office for Chinese Patent Application No. 201210177715.5 dated Feb. 27, 2014, 7pgs.

English translation of Second Office Action issued by the Chinese Patent Office for Chinese Patent Application No. 201210177715.5 dated Feb. 27, 2014, 7pgs.

International Search Report for International Application No. PCT/CN201/085984, 12pgs, Mar. 14, 2013.

International Preliminary Report on Patentability, in PCT Application No. PCT/CN2012/085984, dated Dec. 2, 2014, 9 pages.

* cited by examiner

METHOD AND APPARATUS FOR SETTING GAMMA REFERENCE VOLTAGE, DRIVING CIRCUIT AND DISPLAY APPARATUS

CROSS REFERENCE TO RELATED APPLICATIONS

This application is based on International Application No. PCT/CN2012/085984 filed on Dec. 5, 2012, which claims priority to Chinese National Application No. 201210177715.5 filed on May 31, 2012, the contents of which are incorporated herein by reference.

TECHNICAL FIELD

The present invention relates to a field of display technique, and in particularly, to a method and an apparatus for setting a gamma reference voltage, a driving circuit and a display apparatus.

BACKGROUND

With continuous improvements of the liquid crystal display technique, liquid crystal display products are used widely. With an enhancement of awareness of energy conservation, people's performance requirements on low power consumption of the liquid crystal display products are higher. In the prior art, in order to make sure the gamma reference voltage is not lower than a driving voltage value in case that the gamma reference voltage is decreased due to a capacitive coupling, a liquid crystal display apparatus adds feedback voltages to gamma reference voltages for different gray scales when setting the gamma reference voltages for the different gray scales, so that display quality of the liquid crystal display apparatus can be ensured not to be affected.

The feedback voltages needed to be added are different because gamma reference voltages for respective different gray scales decrease different amounts in case that the gamma reference voltages for the different gray scales decrease due to the capacitive coupling. However, the same feedback voltage, which is a maximum value among the feedback voltages needed to be added for the different gray scales, is added to the gamma reference voltages for the respective different gray scales in the prior art. Therefore, the gamma reference voltages corresponding to part of the gray scales are greater than the gamma reference voltages required actually, which may increase the driving voltage of the display apparatus and in turn increase the power consumption.

SUMMARY

Embodiments of the present disclosure provide a method and an apparatus for setting a gamma reference voltage, a driving circuit and a display apparatus, which may decrease a driving voltage of the display apparatus and reduce the power consumption by resetting the gamma reference voltage of the display apparatus.

In view of this, the embodiments of the present disclosure utilize the following solutions.

A method for setting a gamma reference voltage, comprising: acquiring a dielectric constant of a liquid crystal capacitor according to a first gamma reference voltage; acquiring a value of the liquid crystal capacitor according to the dielectric constant of the liquid crystal capacitor; acquiring a feedback voltage according to the value of the liquid crystal capacitor, acquiring a second gamma reference voltage according to the feedback voltage, and updating the first gamma reference voltage to the second gamma reference voltage.

An apparatus for setting a gamma reference voltage, comprising: a dielectric constant acquiring unit, configured to acquire a dielectric constant of a liquid crystal capacitor according to a first gamma reference voltage; a liquid crystal capacitance acquiring unit, configured to acquire a value of the liquid crystal capacitor according to the dielectric constant of the liquid crystal capacitor; a gamma reference voltage setting unit, configured to acquire a feedback voltage according to the value of the liquid crystal capacitor, acquire a second gamma reference voltage according to the feedback voltage, and update the first gamma reference voltage to the second gamma reference voltage.

A driving circuit, comprising an apparatus for setting a gamma reference voltage, which is the apparatus for setting a gamma reference voltage described above.

A display apparatus, comprising an apparatus for setting a gamma reference voltage, which is the apparatus for setting a gamma reference voltage described above.

The embodiments of the present disclosure provide a method and an apparatus for setting the gamma reference voltage as well as a driving circuit, which acquire the dielectric constant of the liquid crystal capacitor according to the first gamma reference voltage, acquire the value of the liquid crystal capacitor, acquire the feedback voltage according to the value of the liquid crystal capacitor, acquire the value of the second gamma reference voltage according to the feedback voltage, and update the first gamma reference voltage to the second gamma reference voltage. Thus the feedback voltages added to the gamma reference voltages for the different gray scales are different, and so that at least one gray scale has a decreased corresponding gamma reference voltage. The gamma reference voltage of the display apparatus, while meeting the driving voltages for different brightness, may be decreased by resetting the gamma reference voltage of the display apparatus, because the at least one gray scale has the decreased corresponding gamma reference voltage, and the driving voltage of the display apparatus may be decreased and the power consumption may be reduced.

BRIEF DESCRIPTION OF THE DRAWINGS

In order to illustrate embodiments of the disclosure or technical solutions in the prior art clearly, drawings required for a description of the embodiments or the prior art will be described briefly. Apparently, the drawings in the following description are only some embodiments of the present disclosure, and those of ordinary skill in the art may obtain other drawings based on these drawings without creative labors.

DETAILED DESCRIPTION

Solutions in the embodiments of the present disclosure will be described clearly and completely below in conjunction with the accompanying drawings of the embodiments of the present disclosure. It is obvious that the described embodiments are only part of the embodiments of the present disclosure, but not all the embodiments. Based on the embodiments of the present disclosure, other embodiments obtained by those ordinary skilled in the art without creative labors would belong to the protection scope of the present disclosure.

Figure 1:
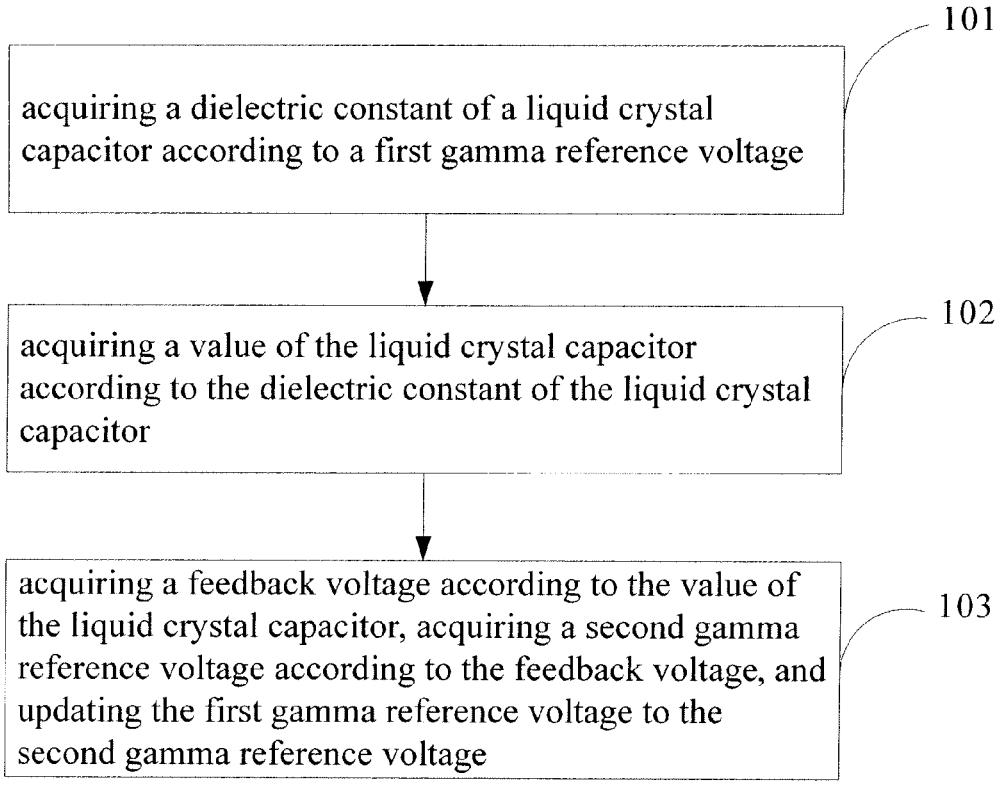
FIG. 1 is a diagram illustrating a method for setting a gamma reference voltage according to an embodiment of the present disclosure.

The embodiments of the present disclosure provide a method for setting a gamma reference voltage, as shown in FIG. 1, which comprises the following processes.

101: a dielectric constant of a liquid crystal capacitor is acquired according to a first gamma reference voltage.

In an example, a driving voltage comprises the gamma reference voltage. The first gamma reference voltage refers to the gamma reference voltage in the driving voltage in the prior art, that is, the gamma reference voltage before updating in the driving voltage.

In particularly, the dielectric constant of the liquid crystal capacitor under the first gamma reference voltage is measured with a measurement instrument(s), according to the first gamma reference voltage.

It should be noted that, in a TN mode, a value of the liquid crystal capacitor is large when the driving voltage is large, and the corresponding value of the liquid crystal capacitor is small when the driving voltage is small. Since different gray scales correspond to different driving voltage values, then different gray scales also correspond to different values of the liquid crystal capacitor. The liquid crystal capacitor is a capacitor with parallel plates wherein an enfilade area of the liquid crystal capacitor and a distance between the two electrode plates will not change after the liquid crystal capacitor is manufactured, therefore, the value of the liquid crystal capacitor will be changed in accordance with the change in the driving voltage by changing the dielectric constant of the liquid crystal capacitor. Different gray scales correspond to different values of the liquid crystal capacitor, that is to say, different gray scales correspond to different dielectric constants. Since different gray scales correspond to different first gamma reference voltages, the different first gamma reference voltages correspond to different dielectric constants.

102: a value of the liquid crystal capacitor is acquired according to the dielectric constant of the liquid crystal capacitor.

In an example, the value of the liquid crystal capacitor may be acquired by a formula $$C_{LC} = \frac{\varepsilon * S}{d}.$$

Wherein $C_{LC}$ is the value of the liquid crystal capacitor, $\in$ is the dielectric constant of the liquid crystal capacitor, S is the enfilade area of the liquid crystal capacitor, and d is the distance between the two electrodes of the liquid crystal capacitor.

103: a feedback voltage is acquired according to the value of the liquid crystal capacitor, a second gamma reference voltage is acquired according to the feedback voltage, and the first gamma reference voltage is updated as the second gamma reference voltage.

In particularly, the feedback voltage is acquired by a formula $$\Delta V_p = \frac{C_{gs} * \Delta V_{ghl}}{C_{gs} + C_{LC} + C_{st}},$$

wherein $\Delta V_p$ is the feedback voltage, $C_{gs}$ is a gate-source capacitance, $\Delta V_{ghl}$ is a difference between a high voltage at the gate and a low voltage at the gate, $C_{st}$ is a storage capacitive, and $C_{LC}$ is the value of the liquid crystal capacitor.

The second gamma reference voltage is acquired according to a formula $$\frac{G_p + G_n}{2} = V_{com} + \Delta V_p;$$

wherein $G_p$ is a positive voltage of the second gamma reference voltage, $G_n$ is a negative voltage of the second gamma reference voltage, $V_{com}$ is a common electrode voltage, and $\Delta V_p$ is the feedback voltage.

It should be noted that the second gamma reference voltage is the actual gamma reference voltage corresponding to the gray scale, and is the gamma reference voltage to be set in the driving voltage. The second gamma reference voltage is smaller than or equal to the first gamma reference voltage.

It should be noted that a magnitude of the feedback voltage $\Delta V_p$ affects the driving voltage of the panel directly, and a calculation formula of $\Delta V_p$ is:

$$\Delta V_p = \frac{C_{gs} * \Delta V_{ghl}}{C_{gs} + C_{LC} + C_{st}},$$

and it can be known from the formula that $\Delta V_p$ varies in accordance with a variation in the value of the liquid crystal capacitor $C_{LC}$. In the TN mode, the value of the liquid crystal capacitor $C_{LC}$ increases when the driving voltage is large, and the value of the liquid crystal capacitor decreases when the driving voltage is small.

Because of the above relationship, the gamma reference voltage may be adjusted by adjusting the feedback voltage $\Delta V_p$, in order to decrease the driving voltage and reduce the power consumption.

The embodiment of the present disclosure provides a method for setting the gamma reference voltage, which acquires the dielectric constant of the liquid crystal capacitor according to the first gamma reference voltage, acquires the value of the liquid crystal capacitor, acquires the feedback voltage according to the value of the liquid crystal capacitor, acquires the value of the second gamma reference voltage according to the feedback voltage, and updates the first gamma reference voltage to the second gamma reference voltage. Thus the feedback voltages added to the gamma reference voltages for the different gray scales are different. The added feedback voltages are different based on a fact that the gamma reference voltages for different gray scales decrease different values when these gamma reference voltages decrease due to a capacitive coupling, and thus at least one gray scale has a decreased corresponding gamma reference voltage. The entire driving voltage of the display apparatus may be decreased and the power consumption may be reduced by resetting the gamma reference voltage of the display apparatus.

Figure 2:
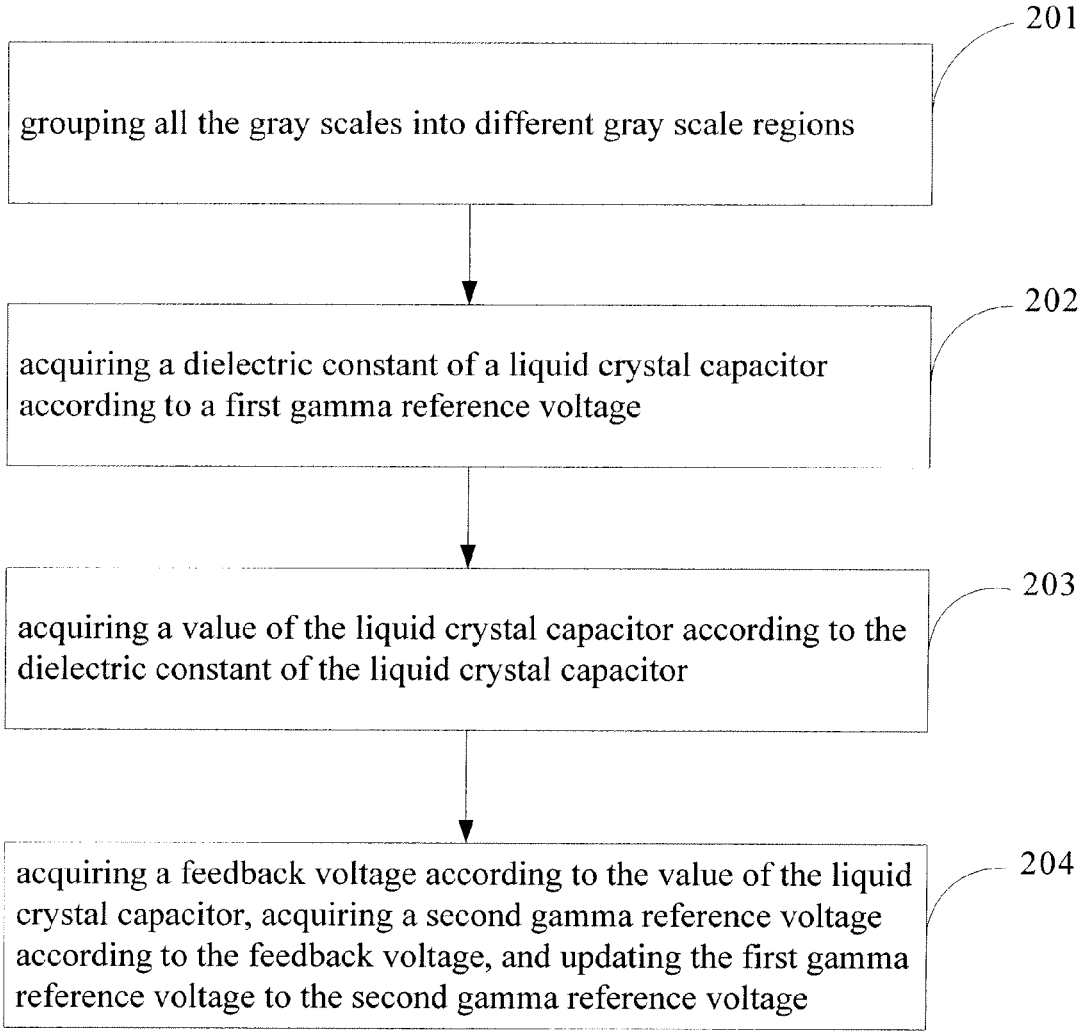
FIG. 2 is a diagram illustrating a method for setting a gamma reference voltage according to another embodiment of the present disclosure.

The embodiments of the present disclosure provide another method for setting the gamma reference voltage, as shown in FIG. 2, which comprises the following processes.

201: all gray scales are grouped into different gray scale regions.

In particularly, all gray scales to which the liquid crystal display apparatus correspond are grouped into different gray scale regions.

Further, the respective first gamma reference voltages corresponding to the different gray scales may be determined firstly, and then all gray scales are grouped into the different gray scale regions.

As an example, the liquid crystal display apparatus has 256 gray scales, and the 256 gray scales may be grouped into three gray scale regions Q1, Q2, Q3. Specifically, gray scales L0-L63 may set as the gray scale region Q1, gray scales L64-L127 may be set as the gray scale region Q2, gray scales L128-L255 may be set as the gray scale region Q3, and the feedback voltages corresponding respectively to the gray scale regions Q1, Q2, Q3 are $\Delta V_{p1}$, $\Delta V_{p2}$, $\Delta V_{p3}$.

Figure 7:
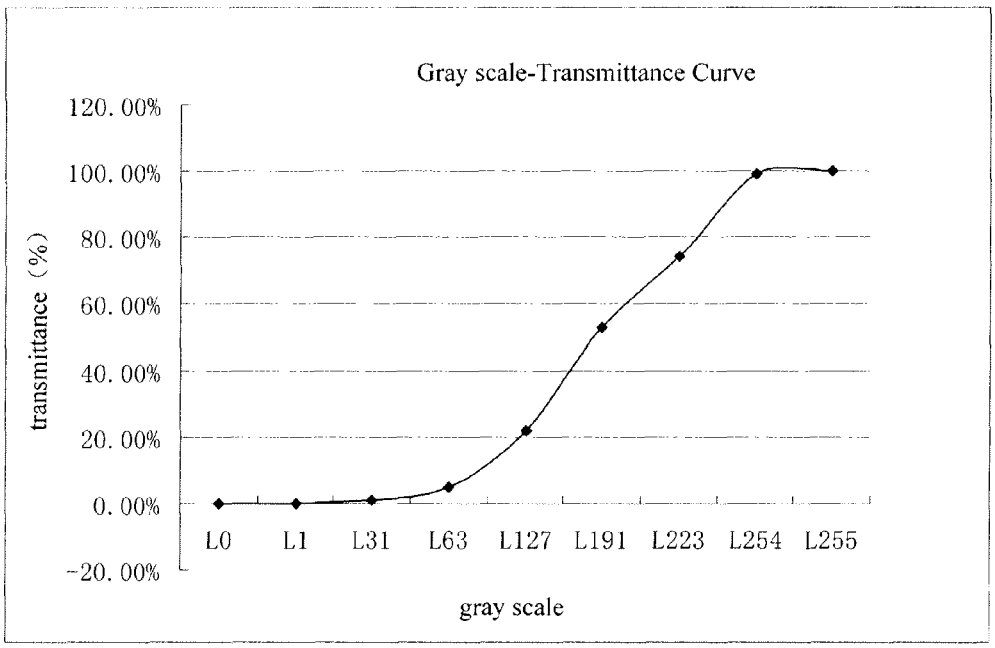
FIG. 7 is a diagram illustrating a gray scale-transmittance curve according to the embodiments of the present disclosure.
Figure 8:
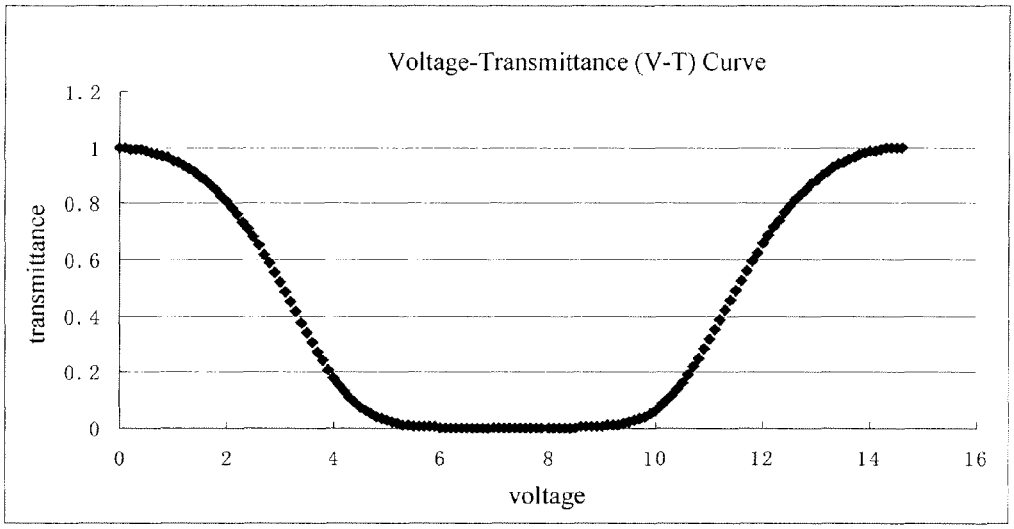
FIG. 8 is a diagram illustrating a voltage-transmittance (V-T) curve according to the embodiments of the present disclosure.

One gray scale region comprises at least one gray scale, and each of the first gamma reference voltages corresponds to at least one different gray scales. A method for determining the first gamma reference voltage comprises the following processes: fitting a required curve of the first gamma reference voltage according to a Gray Scale-Transmittance curve of a TFT liquid crystal display panel, as illustrated in FIG. 7; calculating the values of the first gamma reference voltages corresponding to the respective gray scales based on a formula $\text{Output}=\text{Input}^{Gamma}$, according to a Voltage-Transmittance (V-T) curve of the liquid crystal material, as illustrated in FIG. 8; and then generating respective first gamma reference voltages by a first gamma reference voltage generation circuit, after the respective values of the first gamma reference voltages are calculated. Wherein Output represents a brightness output value required for the TFT liquid crystal display panel, Input represents an input voltage value, Gamma represents the first gamma reference voltage. In FIGS. 7 and 8, a unit of the voltage is Volt (V), a unit of the transmittance is percent (%), and a unit of the gray scale is level.

It should be noted that, the gray scales, to which the first gamma reference voltages whose values are close but different correspond, are grouped into a same gray scale region, when all the gray scale are grouped into the different gray scale regions.

In should be noted that the diagrams in FIGS. 7 and 8 illustrate the Gray Scale-Transmittance curve and the Voltage-Transmittance (V-T) curve of the TN structure in a Normal White mode, and a Gray Scale-Transmittance curve and a Voltage-Transmittance (V-T) curve of the TN structure in a Normal Black mode are not shown. However, those skilled in the art may understand that the first gamma reference voltages are obtained according to the Gray Scale-Transmittance curve and the Voltage-Transmittance (V-T) curve, and the present disclosure has no limitation on the mode of the TN structure.

202: a dielectric constant of a liquid crystal capacitor is acquired according to the first gamma reference voltage.

In particularly, since step 201 groups all gray scales into different gray scale regions, a method for acquiring the dielectric constant of the liquid crystal capacitor in one gray scale region comprises the following processes: selecting one gray scale within this gray scale region; acquiring a first gamma reference voltage corresponding to this gray scale; and acquiring a dielectric constant of the liquid crystal capacitor under this first gamma reference voltage, as the dielectric constant of the liquid crystal capacitor for this gray scale region.

Optionally, the dielectric constants of the liquid crystal capacitor corresponding to the different gray scales are obtained according to the first gamma reference voltages for different gray scales within one gray scale region, and an average of the dielectric constants in this gray scale region is calculated.

As described above, the 256 gray scales are grouped into 3 gray scale regions Q1, Q2, Q3. According to the different first gamma reference voltages respectively corresponding to the different gray scales L0-L63 within the gray scale region Q1, a plurality of different dielectric constants of the liquid crystal capacitor under the different first gamma reference voltages within the gray scale region Q1 are obtained, and the average of the dielectric constants of the liquid crystal capacitor within the Q1 is acquired. According to the different first gamma reference voltages respectively corresponding to the different gray scales L64-L127 within the gray scale region Q2, a plurality of different dielectric constants of the liquid crystal capacitor under the different first gamma reference voltages within the gray scale region Q2 are obtained, and the average of the dielectric constants of the liquid crystal capacitor within the Q2 is acquired. According to the different first gamma reference voltages respectively corresponding to the different gray scales L128-L255 within the gray scale region Q3, a plurality of different dielectric constants of the liquid crystal capacitor under the different first gamma reference voltages within the gray scale region Q3 are obtained, and the average of the dielectric constants of the liquid crystal capacitor within the Q3 is acquired It should be noted that, in the above example, the 256 gray scales are grouped into 3 gray scale regions, however, the 256 gray scales may be grouped into 4 gray scale regions, or 5 gray scale regions, and the present disclosure has no limited for this.

203: a value of the liquid crystal capacitor is acquired according to the dielectric constant of the liquid crystal capacitor.

Wherein a method for acquiring the value of the liquid crystal capacitor corresponding to one gray scale region is acquiring the value of the liquid crystal capacitor corresponding to the gray scale region according to the average of the dielectric constants corresponding to the gray scale region.

In particularly, the value of the liquid crystal capacitor is acquired according to a formula $$C_{LC} = \frac{\varepsilon_1 * S}{d};$$

wherein $C_{LC}$ is the value of the liquid crystal capacitor, $\in_1$ is the dielectric constant of the liquid crystal capacitor, S is an enfilade area of the liquid crystal capacitor, and d is a distance between two electrodes of the liquid crystal capacitor.

It should be noted that $\in_1$ is the dielectric constant calculated at step 202. If the dielectric constant calculated at step 202 is the dielectric constant corresponding to one gray scale within the gray scale region, then $\in_1$ is the dielectric constant corresponding to this gray scale; if the dielectric constant calculated at step 202 is the average of the different dielectric constants within the gray scale region, then $\in_1$ is the average of the different dielectric constants within this gray scale region.

204: a feedback voltage $\Delta V_p$ is acquired according to the value of the liquid crystal capacitor, a second gamma reference voltage is acquired according to the feedback voltage, and the first gamma reference voltage is updated to the second gamma reference voltage.

It should be noted that there are two methods for updating the first gamma reference voltage as the second gamma reference voltage. The first one is as follows: calculating the second gamma reference voltage corresponding to one gray scale region directly, after the feedback voltage corresponding to said gray scale region is acquired; and updating all of the first gamma reference voltages within said gray scale region to the second gamma reference voltage. The second one is as follows: determining, according to respective feedback voltages corresponding to respective gray regions, gray scale regions to which the respective feedback voltages belong, after the respective feedback voltages are acquired; calculating second gamma reference voltages corresponding to the respective gray scale regions; and updating all the first gamma reference voltages within each of the gray scale regions to which the respective feedback voltages respectively belong to the second gamma reference voltages correspondingly.

In particularly, the first method may acquire the feedback voltage according to the value of the liquid crystal capacitor corresponding to one gray scale region, which is acquired at step 203, acquire the second gamma reference voltage corresponding to said gray scale region according to the feedback voltage, update all the first gamma reference voltages within said gray scale region to the second gamma reference voltage, acquire the feedback voltage corresponding to a next gray scale region, acquire the second gamma reference voltage according to the feedback voltage, update all the first gamma reference voltage within this gray scale region to the second gamma reference voltage; until update all the first gamma reference voltage in the last gray scale region to the second gamma reference voltage.

Wherein, the feedback voltage is acquired by a formula $$\Delta V_p = \frac{C_{gs} * \Delta V_{ghl}}{C_{gs} + C_{LC} + C_{st}},$$

wherein $\Delta V_p$ is the feedback voltage, $C_{gs}$ is a gate-source capacitance, $\Delta V_{ghl}$ is a difference between a high voltage at the gate and a low voltage at the gate, $C_{st}$ is a storage capacitive, and $C_{LC}$ is the value of the liquid crystal capacitor.

The second gamma reference voltage is acquired according to a formula $$\frac{G_p + G_n}{2} = V_{com} + \Delta V_p;$$

wherein $G_p$ is a positive voltage of the second gamma reference voltage, $G_n$ is a negative voltage of the second gamma reference voltage, $V_{com}$ is a common electrode voltage, and $\Delta V_p$ is the feedback voltage.

For example, as described above, the feedback voltage corresponding to the gray scale region Q1 is acquired by the formula $$\Delta V_p = \frac{C_{gs} * \Delta V_{ghl}}{C_{gs} + C_{LC} + C_{st}}$$

after the value of the liquid crystal capacitor corresponding to the gray scale region Q1 is acquired at step 203, the second gamma reference voltage corresponding to the gray scale region Q1 is acquired by the formula $$\frac{G_p + G_n}{2} = V_{com} + \Delta V_p,$$

and all of the first gamma reference voltages within the gray scale region Q1 are updated to the second gamma reference voltage, that is, the 64 first gamma reference voltages within the gray scale region Q1 are updated to the second gamma reference voltage. After all of the first gamma reference voltages within the gray scale region Q1 are updated to the second gamma reference voltage, the feedback voltage corresponding to the feedback voltage region Q2 is acquired, the second gamma reference voltage corresponding to the gray scale region Q2 is acquired according to the feedback voltage corresponding to the gray scale region Q2, and then all of the first gamma reference voltages within the gray scale region Q2 are updated to the second gamma reference voltage. After all of the first gamma reference voltages within the gray scale region Q2 are updated to the second gamma reference voltage, the feedback voltage corresponding to the feedback voltage region Q3 is acquired, the second gamma reference voltage corresponding to the gray scale region Q3 is acquired according to the feedback voltage corresponding to the gray scale region Q3, and all of the first gamma reference voltages within the gray scale region Q3 are updated to the second gamma reference voltage.

It should be noted that the order in the above example may be changed as needed, and the present disclosure has no limitation thereto.

Regarding the second method, before acquiring the second gamma reference voltage according to the feedback voltage, it further comprises: determining the gray scales to which the respective feedback voltages belong according to the respective feedback voltages.

In particularly, feedback voltages corresponding to different gray scale regions respectively are acquired according to respective values of the liquid crystal capacitor corresponding to the different gray scale regions; the gray scale regions to which the feedback voltages respectively belong are determined according to the respective feedback voltages; second gamma reference voltages corresponding to the gray scale regions to which the feedback voltages respectively belong are acquired according to the respective feedback voltages; and all the first gamma reference voltages within each of the gray scale regions to which the feedback voltages respectively belong are updated to the respective second gamma reference voltage.

For example, as described above, the feedback voltage $\Delta V_{p1}$ corresponding to the gray scale region Q1 is acquired by the formula $$\Delta V_p = \frac{C_{gs} * \Delta V_{ghl}}{C_{gs} + C_{LC} + C_{st}}$$

after the value of the liquid crystal capacitor corresponding to the gray scale region Q1 is acquired; the feedback voltage $\Delta V_{p2}$ corresponding to the gray scale region Q2 is acquired by the formula $$\Delta V_p = \frac{C_{gs} * \Delta V_{ghl}}{C_{gs} + C_{LC} + C_{st}}$$

after the value of the liquid crystal capacitor corresponding to the gray scale region Q2 is acquired; and the feedback voltage $\Delta V_{p3}$ corresponding to the gray scale region Q3 is acquired by the formula $$\Delta V_p = \frac{C_{gs} * \Delta V_{ghl}}{C_{gs} + C_{LC} + C_{st}}$$

after the value of the liquid crystal capacitor corresponding to the gray scale region Q3 is acquired. The corresponding second gamma reference voltage is calculated for each of the gray scale regions Q1, Q2, Q3 by the formula $$\frac{G_p + G_n}{2} = V_{com} + \Delta V_p,$$

after the feedback voltages $\Delta V_{p1}$, $\Delta V_{p2}$, $\Delta V_{p3}$ are acquired. At last, for each of the gray scale regions Q1, Q2, Q3, all of the first gamma reference voltages therein are updated to the corresponding second gamma reference voltage.

In particularly, regarding the gray scale region Q1, its corresponding feedback voltage is $\Delta V_{p1}$, the second gamma reference voltage corresponding to the gray scale region Q1 is acquired according to the formula $$\frac{G_p + G_n}{2} = V_{com} + \Delta V_p,$$

and then all of the first gamma reference voltages within the gray scale region Q1 are updated to the second gamma reference voltage. Regarding the gray scale region Q2, its corresponding feedback voltage is $\Delta V_{p2}$, the second gamma reference voltage corresponding to the gray scale region Q2 is acquired according to the formula $$\frac{G_p + G_n}{2} = V_{com} + \Delta V_p,$$

and all of the first gamma reference voltages within the gray scale region Q2 are updated to the second gamma reference voltage. Regarding the gray scale region Q3, its corresponding feedback voltage is $\Delta V_{p3}$, the second gamma reference voltage corresponding to the gray scale region Q3 is acquired according to the formula $$\frac{G_p + G_n}{2} = V_{com} + \Delta V_p,$$

and all of the first gamma reference voltages within the gray scale region Q3 are updated to the second gamma reference voltage.

It should be noted that the magnitude of the feedback voltage $\Delta V_p$ affects the driving voltage of the display apparatus directly, and there is a direct proportion relationship between them. The calculation formula of $\Delta V_p$ is:

$$\Delta V_p = \frac{C_{gs} * \Delta V_{ghl}}{C_{gs} + C_{LC} + C_{st}},$$

therefore it can be known from the formula that that $\Delta V_p$ varies in accordance with a variation in the value of the liquid crystal capacitor $C_{LC}$. In the TN mode, the value of the liquid crystal capacitor $C_{LC}$ increases when the driving voltage is large, and the value of the liquid crystal capacitor decreases when the driving voltage is small.

Because of the above relationship, the gamma reference voltage may be adjusted by adjusting the feedback voltage $\Delta V_p$, in order to decrease the driving voltage and reduce the power consumption.

For the TN structure in the Normal While mode, the driving voltage is the largest at L0, that is, the driving voltage for the gray scale region Q1 is the largest, therefore its corresponding liquid crystal capacitance is the largest, and thus $\Delta V_{p1}$ corresponding to the gray scale region Q1 is the smallest; on the contrary, $\Delta V_{p3}$ corresponding to the gray scale region Q3 is the largest.

Because different feedback voltages $\Delta V_p$ correspond to different gamma reference voltages, it can be known from the formula $$\frac{G_p + G_n}{2} = V_{com} + \Delta V_p$$

that, in a case that the common voltage is unchanged, the gamma reference voltage is small when the feedback voltage $\Delta V_p$ is small. Therefore, after the first gamma reference voltages within the gray scale region Q1 are updated to the second gamma reference voltage, the gamma reference voltage in the gray scale region Q1 is the smallest; correspondingly, the gamma reference voltage in the gray scale region Q3 is the largest.

Similarly, for the TN structure in the Normal Black mode, the driving voltage is the smallest at L0, that is, the driving voltage for the gray scale region Q1 is the smallest, therefore its corresponding liquid crystal capacitance is the smallest, and thus $\Delta V_{p1}$ corresponding to the gray scale region Q1 is the largest; on the contrary, $\Delta V_{p3}$ corresponding to the gray scale region Q3 is the smallest.

Because different feedback voltages $\Delta V_p$ correspond to different gamma reference voltages, it can be known from the formula $$\frac{G_p + G_n}{2} = V_{com} + \Delta V_p$$

that, in a case that the common voltage is unchanged, the gamma reference voltage is large when the feedback voltage $\Delta V_p$ is large. Therefore, after the first gamma reference voltages within the gray scale region Q1 are updated to the second gamma reference voltage, the gamma reference voltage in the gray scale region Q1 is the largest; correspondingly, the gamma reference voltage in the gray scale region Q3 is the smallest.

In the prior art, a largest feedback voltage $\Delta V_p$ is added to the gamma reference voltages for different gray scale regions, in order that all the gamma reference voltages for different gray scale regions may reach their own preset desired values after the voltages decrease due to the capacitive coupling effect. On the contrary, the second gamma reference voltages mentioned in the embodiments of the present disclosure are calculated according to actual situation in different gray scale regions, therefore the feedback voltage $\Delta V_p$ may decrease as compared with that corresponding to the previous original gamma reference voltage (the first gamma reference voltage), so that the power consumption may be reduced. Thus the value of the second gamma reference voltage corresponding to at least one gray scale is lower as compared with the value of the first gamma reference voltage by setting different feedback voltages $\Delta V_p$ for the different gray scale regions, so the power consumption can be reduced.

As a result, the added feedback voltages are different based on a fact that the gamma reference voltages for different gray scales decrease different values when these gamma reference voltages decrease due to a capacitive coupling, and thus at least one gray scale has a decreased gamma reference voltage as compared with the corresponding gamma reference voltage in the prior art. Therefore, the entire driving voltage is decreased and the power consumption is reduced.

The embodiments of the present disclosure consider the changes of the liquid crystal capacitance caused by different gamma reference voltages, as well as the affect on the feedback voltage $\Delta V_p$ due to the changes of the liquid crystal capacitance, and calculate new gamma reference voltages according to the values of the feedback voltages $\Delta V_p$ in different gray scale regions.

That is to say, the dielectric constants of the liquid crystal capacitor are measured under the gamma reference voltage values of different gray scale regions at first, then the different values of the liquid crystal capacitor $C_{LC}$ are acquired based on different dielectric constants of the liquid crystal capacitor, the different values of the liquid crystal capacitor $C_{LC}$ determine different feedback voltages $\Delta V_p$, and the different feedback voltages $\Delta V_p$ determine the new gamma reference voltages. As a result, the gamma reference voltage is adjusted.

The value of the new gamma reference voltage (the second gamma reference voltage) is acquired through a series of calculations based on the value of the original gamma reference voltage before adjusting (the first gamma reference voltage), so the value of this new gamma reference voltage is lower than that of the original gamma reference voltage and may reduce the power consumption. If the value of the new gamma reference voltage plays the role of the value of the original gamma reference voltage and said series of calculations are performed again, the acquired gamma reference voltage should be consistent with the new gamma reference voltage and has no substantive change, so this gamma reference voltage would have no substantive change even if said calculations are iterated. Alternatively, we can perform said calculations more than one times for adjusting finely gradually if there is a change, in order to achieve a more accurate gamma reference voltage.

The embodiments of the present disclosure provide a method for setting the gamma reference voltage, all the gray scales are grouped into different gray scale regions at first; and for each of the gray scale regions, it is necessary to acquire the dielectric constants of the liquid crystal capacitor according to the first gamma reference voltages corresponding to different gray scales within said gray scale region and calculate the average of the dielectric constants, acquire the value of the liquid crystal capacitor corresponding to the gray scale region according to the average of the dielectric constants corresponding to the gray scale region, acquire the feedback voltage corresponding to the gray scale region according to the value of the liquid crystal capacitor corresponding to the gray scale region, acquire the second gamma reference voltage corresponding to the gray scale region according to the feedback voltage corresponding to the gray scale region, and update all of the first gamma reference voltages within the gray scale region to the second gamma reference voltage, so as to make the feedback voltages added to the gamma reference voltages different for the different gray scales. The added feedback voltages are different based on a fact that the gamma reference voltages for different gray scales decrease different values when these gamma reference voltages decrease due to a capacitive coupling, and thus at least one gray scale has a decreased corresponding gamma reference voltage. The entire driving voltage of the display apparatus may be decreased and the power consumption may be reduced by resetting the gamma reference voltage of the display apparatus.

Figure 3:
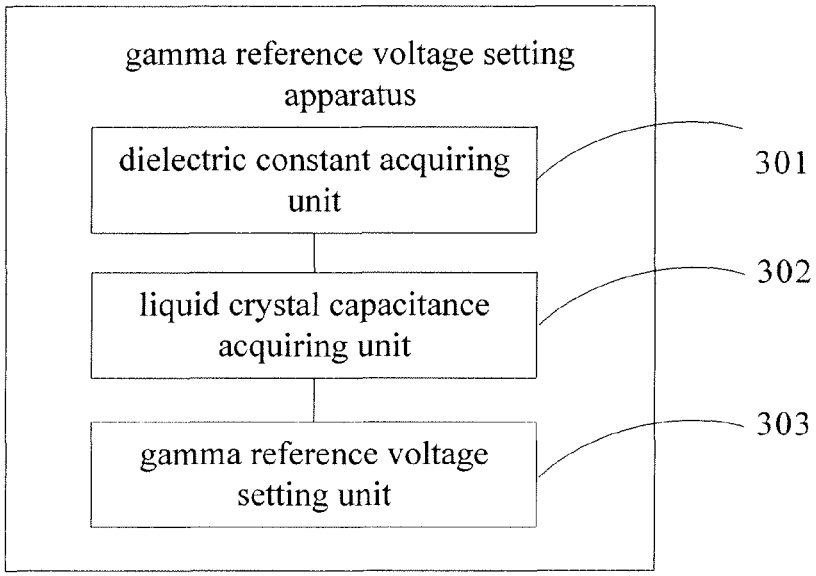
FIG. 3 is a diagram illustrating a structure of an apparatus for setting a gamma reference voltage according to an embodiment of the present disclosure.

An embodiment of the present disclosure provides an apparatus for setting a gamma reference voltage, as shown in FIG. 3, which comprises the following parts.

a dielectric constant acquiring unit 301 is configured to acquire a dielectric constant of a liquid crystal capacitor according to a first gamma reference voltage.

a liquid crystal capacitance acquiring unit 302 is configured to acquire a value of the liquid crystal capacitor according to the dielectric constant of the liquid crystal capacitor.

In an example, the liquid crystal capacitance acquiring unit 302 may acquire the value of the liquid crystal capacitor by a formula $$C_{LC} = \frac{\varepsilon * S}{d};$$

wherein $C_{LC}$ is the value of the liquid crystal capacitor, $\in$ is the dielectric constant of the liquid crystal capacitor, S is an enfilade area of the liquid crystal capacitor, and d is a distance between the two electrodes of the liquid crystal capacitor.

a gamma reference voltage setting unit 303 is configured to acquire a feedback voltage according to the value of the liquid crystal capacitor, acquire a second gamma reference voltage according to the feedback voltage, and update the first gamma reference voltage to the second gamma reference voltage.

In an example, the gamma reference voltage setting unit 303 may acquire the feedback voltage by a formula $$\Delta V_p = \frac{C_{gs} * \Delta V_{ghl}}{C_{gs} + C_{LC} + C_{st}};$$

wherein $\Delta V_p$ is the feedback voltage, $C_{gs}$ is a gate-source capacitance, $\Delta V_{ghl}$ is a difference between a high voltage at the gate and a low voltage at the gate, $C_{st}$ is a storage capacitance, and $C_{LC}$ is the value of the liquid crystal capacitor.

The gamma reference voltage setting unit 303 may acquire the second gamma reference voltage by a formula $$\frac{G_p + G_n}{2} = V_{com} + \Delta V_p,$$

wherein $G_p$ is a positive voltage of the second gamma reference voltage, $G_n$ is a negative voltage of the second gamma reference voltage, $V_{com}$ is a common electrode voltage, and $\Delta V_p$ is the feedback voltage.

Figure 4:
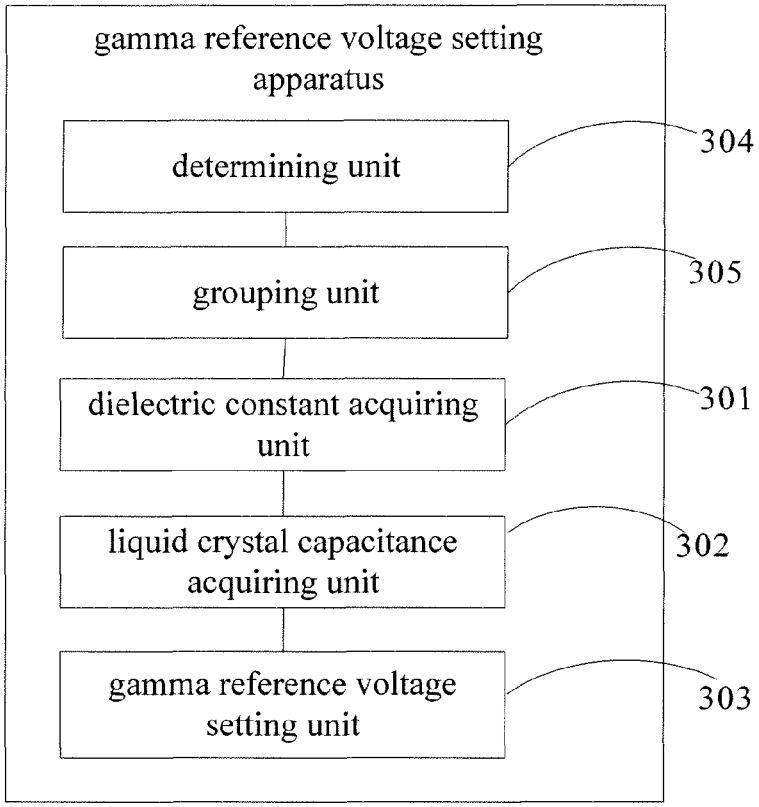
FIG. 4 is a diagram illustrating a structure of an apparatus for setting a gamma reference voltage according to another embodiment of the present disclosure.

According to another embodiment of the present disclosure, the apparatus for setting the gamma reference voltage, as illustrated in FIG. 4, may further comprise: a determining unit 304, configured to determine first gamma reference voltages corresponding to the different gray scales respectively; a grouping unit 305, configured to group all the gray scales into different gray scale regions.

In particularly, the dielectric constant acquiring unit 301 is configured for acquiring, according to respective first gamma reference voltages corresponding to different gray scales within one of the gray scale regions, dielectric constants of the liquid crystal capacitor corresponding to the different gray scales respectively, and acquiring an average of the dielectric constants in said gray scale region.

In particularly, the liquid crystal capacitance acquiring unit 302 is configured for acquiring the value of the liquid crystal capacitor corresponding to said gray scale region according to the average of the dielectric constants corresponding to said gray scale region.

Figure 5:
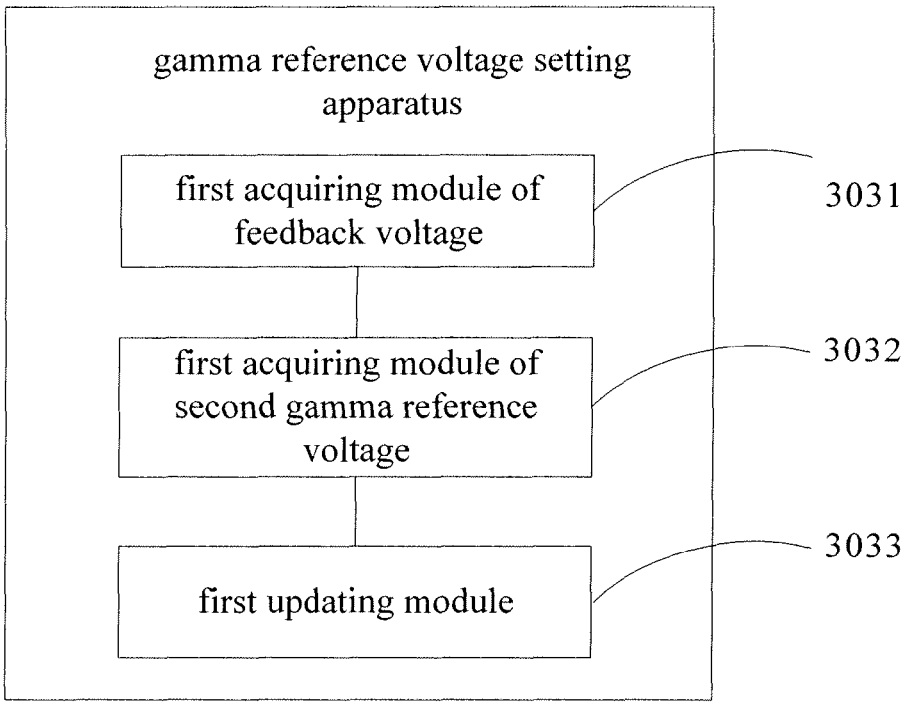
FIG. 5 is a structural diagram of a gamma reference voltage setting unit shown in FIG. 4.

As shown in FIG. 5, the gamma reference voltage setting unit 303 comprises a first acquiring module of feedback voltage 3031, a first acquiring module of second gamma reference voltage 3032 and a first updating module 3033.

The first acquiring module of feedback voltage 3031 is configured to acquire the feedback voltage for one of the gray scale regions according to the value of the liquid crystal capacitor corresponding to the gray scale region.

The first acquiring module of second gamma reference voltage 3032 is configured to acquire the second gamma reference voltage corresponding to the gray scale region according to the feedback voltage acquired by the first acquiring module for feedback voltage.

The first updating module 3033 is configured to update all the first gamma reference voltages within the gray scale region to the second gamma reference voltage according to the second gamma reference voltage acquired by the first acquiring module for feedback voltage.

Figure 6:
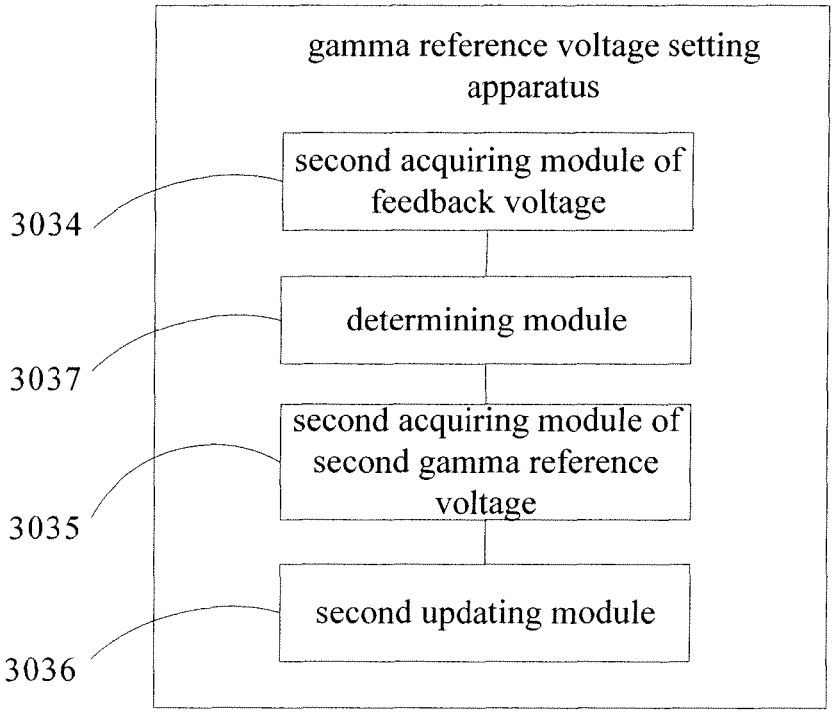
FIG. 6 is another structural diagram of the gamma reference voltage setting unit shown in FIG. 4.

Alternatively, as shown in FIG. 6, the gamma reference voltage setting unit comprises: a second acquiring module of feedback voltage 3034, a second acquiring module of second gamma reference voltage 3035, a second updating module 3036, and a determining module 3037.

The second acquiring module of feedback voltage 3034 is configured to acquire, according to respective values of the liquid crystal capacitor corresponding to the different gray scale regions, feedback voltages corresponding to the different gray scale regions respectively.

The determining module 3037 is configured to determine the gray scale regions to which the feedback voltages respectively belong according to the respective feedback voltages acquired by the second acquiring module of feedback voltage 3034.

The second acquiring module of second gamma reference voltage 3035 is configured to acquire second gamma reference voltages corresponding to the gray scale regions to which the feedback voltages respectively belong according to the respective feedback voltages acquired by the second acquiring module of feedback voltage 3034.

The second updating module 3036 is configured to update all the first gamma reference voltages within each of the gray scale regions to which the feedback voltages respectively belong as the respective second gamma reference voltage according to the second gamma reference voltages acquired by the second acquiring module of second gamma reference voltage 3035.

An embodiment of the present disclosure further provides a driving circuit, comprising a gamma reference voltage setting apparatus, a driving voltage setting apparatus and a driving voltage outputting apparatus, wherein the gamma reference voltage setting apparatus is the apparatus for setting the gamma reference voltage described in the above embodiments. The driving circuit comprises, but not limit to, a source driving circuit of the display apparatus.

Wherein the source driving circuit is a circuit for driving data lines in the display panel with a voltage corresponding to a data signal received from a controller. The source driving circuit comprises the apparatus for setting the gamma reference voltage, which is configured for setting gamma reference voltages corresponding to different gray scales, and transferring the set gamma reference voltages to the driving voltage setting apparatus so that the driving voltage setting apparatus may set the gamma reference voltage received as the driving voltage, and transferring the driving voltage to the driving voltage outputting apparatus so that the driving voltage outputting apparatus may output the driving voltage to drive the data lines and generate liquid crystal capacitance to deflect the liquid crystal.

In particularly, the apparatus for setting the gamma reference voltage acquires the dielectric constant of the liquid crystal capacitor according to the first gamma reference voltage, acquires the value of the liquid crystal capacitor, acquires the feedback voltage according to the value of the liquid crystal capacitor, acquires a value of the second gamma reference voltage according to the feedback voltage, and updates the first gamma reference voltage as the second gamma reference voltage. Therefore, the feedback voltages added to the gamma reference voltages are different for the different gray scales, and, among gamma reference voltages corresponding to different gray scales output from the apparatus for setting the gamma reference voltage according to the embodiments of the present disclosure, gamma reference voltage for at least one gray scale is lower than the gamma reference voltage corresponding to this gray scale output from the apparatus for setting the gamma reference voltage in the prior art. The apparatus for setting the gamma reference voltage transfers the gamma reference voltage to the driving voltage setting apparatus, the driving voltage setting apparatus sets the gamma reference voltage as the driving voltage after receiving the gamma reference voltage, and transfers the driving voltage to the driving voltage outputting apparatus, so that the driving voltage outputting apparatus outputs the driving voltage to drive the data lines and generates the liquid crystal capacitance to deflect the liquid crystal.

The gamma reference voltages set by the apparatus for setting the gamma reference voltage are different because the feedback voltages added to the gamma reference voltage for different gray scales by the apparatus for setting the gamma reference voltage are different, and at least one gamma reference voltage is lower than the one set by the apparatus for setting the gamma reference voltage in the prior art, therefore the driving voltage set by the driving voltage setting apparatus is lower than that set by the driving voltage setting apparatus in the prior art, so that the gamma reference voltage of the display apparatus may be decreased, the driving voltage of the display apparatus may be decreased and the power consumption may be reduced, while meeting driving voltages for different brightness.

The embodiments of the present disclosure further provide a display apparatus, comprising an apparatus for setting a gamma reference voltage, the apparatus for setting the gamma reference voltage is the apparatus for the gamma reference voltage described in the above embodiments.

The embodiments of the present disclosure provide a method and apparatus for setting the gamma reference voltage, a driving circuit and a display apparatus, which acquire a dielectric constant of a liquid crystal capacitor according to a first gamma reference voltage, acquire a value of the liquid crystal capacitor, acquire a feedback voltage according to the value of the liquid crystal capacitor, acquire a second gamma reference voltage value according to the feedback voltage, and update the first gamma reference voltage to the second gamma reference voltage. Thus the feedback voltages added to the gamma reference voltages for the different gray scales are different, and the gamma reference voltage corresponding to at least one gray scale decreases. Since the gamma reference voltage corresponding to at least one gray scale decreases, the gamma reference voltage for the display apparatus may be decreased by resetting the gamma reference voltage for the display apparatus, and thus the driving voltage of the display apparatus may be decreased and the power consumption may be reduced, while meeting driving voltages for different brightness Above are only specific embodiments of the present disclosure, but the scope of the present disclosure is not limited thereto, and changes or replacements which can be conceived easily by any persons skilled in the art are covered within the scope sought for protection of the present disclosure. Thus, the scope of the invention should be defined by the claims.

What is claimed is:

1. A method for setting a gamma reference voltage, comprising:

acquiring a dielectric constant of a liquid crystal capacitor according to a first gamma reference voltage;

acquiring a value of the liquid crystal capacitor according to the dielectric constant of the liquid crystal capacitor;

acquiring a feedback voltage according to the value of the liquid crystal capacitor, acquiring a second gamma reference voltage according to the feedback voltage, and updating the first gamma reference voltage to the second gamma reference voltage;

wherein before acquiring a dielectric constant of a liquid crystal capacitor according to a first gamma reference voltage, further comprising:

determining first gamma reference voltages corresponding to different gray scales, respectively;

grouping all the gray scales into different gray scale regions; and wherein acquiring a dielectric constant of a liquid crystal capacitor according to a first gamma reference voltage comprises: acquiring, according to respective first gamma reference voltages corresponding to different gray scales within one of the gray scale regions, dielectric constants of the liquid crystal capacitor corresponding to the different gray scales respectively, and acquiring an average of the dielectric constants in said gray scale region;

wherein acquiring a value of the liquid crystal capacitor according to the dielectric constant of the liquid crystal capacitor comprises: acquiring the value of the liquid crystal capacitor corresponding to said gray scale region according to the average of the dielectric constants corresponding to said gray scale region.

2. The method according to claim 1, wherein acquiring a feedback voltage according to the value of the liquid crystal capacitor, acquiring a second gamma reference voltage according to the feedback voltage, and updating the first gamma reference voltage to the second gamma reference voltage comprises:

performing the following processing for each of the gray scale regions: acquiring the feedback voltage according to the value of the liquid crystal capacitor corresponding to the gray scale region; acquiring the second gamma reference voltage corresponding to the gray scale region according to the feedback voltage; and updating all the first gamma reference voltages within the gray scale region to the second gamma reference voltage.

3. The method according to claim 1, wherein acquiring a feedback voltage according to the value of the liquid crystal capacitor, acquiring a second gamma reference voltage according to the feedback voltage, and updating the first gamma reference voltage to the second gamma reference voltage comprises:

acquiring, according to respective values of the liquid crystal capacitors corresponding to the different gray scale regions, feedback voltages corresponding to the different gray scale regions respectively; determining the gray scale regions to which the feedback voltages respectively belong; acquiring second gamma reference voltages corresponding to the gray scale regions to which the feedback voltages respectively belong; and updating all the first gamma reference voltages within each of the gray scale regions to which the feedback voltages respectively belong as the respective second gamma reference voltage.

4. The method according to claim 1, wherein acquiring a value of the liquid crystal capacitor according to the dielectric constant of the liquid crystal capacitor comprises:

acquiring the value of the liquid crystal capacitor according to a formula $$C_{LC} = \frac{\varepsilon * S}{d};$$

wherein $C_{LC}$ is the value of the liquid crystal capacitor, $\in$ is the dielectric constant of the liquid crystal capacitor, S is an enfilade area of the liquid crystal capacitor, and d is a distance between two electrodes of the liquid crystal capacitor.

5. The method according to claim 1, wherein acquiring a feedback voltage according to the value of the liquid crystal capacitor comprises:

acquiring the feedback voltage according to a formula $$\Delta V_p = \frac{C_{gs} * \Delta V_{ghl}}{C_{gs} + C_{LC} + C_{st}},$$

wherein $\Delta V_p$ is the feedback voltage, $C_{gs}$ is a gate-source capacitance, $\Delta V_{ghl}$ is a difference between a high voltage at the gate and a low voltage at the gate, $C_{st}$ is a storage capacitance, and $C_{LC}$ is the value of the liquid crystal capacitor.

6. The method according to claim 1, wherein acquiring a second gamma reference voltage according to the feedback voltage comprises:

acquiring the second gamma reference voltage according to a formula $$\frac{G_p + G_n}{2} = V_{com} + \Delta V_p,$$

wherein $G_p$ is a positive voltage of the second gamma reference voltage, $G_n$ is a negative voltage of the second gamma reference voltage, $V_{com}$ is a common electrode voltage, and $\Delta V_p$ is the feedback voltage.

7. An apparatus for setting a gamma reference voltage, comprising:

a dielectric constant acquiring unit, configured to acquire a dielectric constant of a liquid crystal capacitor according to a first gamma reference voltage;

a liquid crystal capacitance acquiring unit, configured to acquire a value of the liquid crystal capacitor according to the dielectric constant of the liquid crystal capacitor;

a gamma reference voltage setting unit, configured to acquire a feedback voltage according to the value of the liquid crystal capacitor, acquire a second gamma reference voltage according to the feedback voltage, and update the first gamma reference voltage to the second gamma reference voltage;

a determining unit, configured to determine first gamma reference voltages corresponding to the different gray scales respectively; and a grouping unit, configured to group all the gray scales into different gray scale regions;

wherein the dielectric constant acquiring unit is configured to acquire, according to respective first gamma reference voltages corresponding to different gray scales within one of the gray scale regions, dielectric constants of the liquid crystal capacitor corresponding to the different gray scales respectively, and acquire an average of the dielectric constants in said gray scale region; and wherein the liquid crystal capacitance acquiring unit is configured to acquire the value of the liquid crystal capacitor corresponding to said gray scale region according to the average of the dielectric constants corresponding to said gray scale region.

8. The apparatus according to claim 7, wherein the gamma reference voltage setting unit comprises:

a first acquiring module of feedback voltage, configured to acquire the feedback voltage for one of the gray scale regions according to the value of the liquid crystal capacitor corresponding to the gray scale region;

a first acquiring module of second gamma reference voltage, configured to acquire the second gamma reference voltage corresponding to the gray scale region according to the feedback voltage acquired by the first acquiring module for feedback voltage;

a first updating module, configured to update all the first gamma reference voltages within the gray scale region to the second gamma reference voltage according to the second gamma reference voltage acquired by the first acquiring module for feedback voltage.

9. The apparatus according to claim 7, wherein the gamma reference voltage setting unit comprises:

a second acquiring module of feedback voltage, configured to acquire, according to respective values of the liquid crystal capacitor corresponding to the different gray scale regions, feedback voltages corresponding to the different gray scale regions respectively;

a determining module, configured to determine the gray scale regions to which the feedback voltages respectively belong;

a second acquiring module of second gamma reference voltage, configured to acquire second gamma reference voltages corresponding to the gray scale regions to which the feedback voltages respectively belong;

a second updating module, configured to update all the first gamma reference voltages within each of the gray scale regions to which the feedback voltages respectively belong as the respective second gamma reference voltage.

10. A driving circuit, comprising a driving voltage setting apparatus, a driving voltage outputting apparatus, and an apparatus for setting a gamma reference voltage;

wherein the apparatus for setting the gamma reference voltage comprises:

a dielectric constant acquiring unit, configured to acquire a dielectric constant of a liquid crystal capacitor according to a first gamma reference voltage;

a liquid crystal capacitance acquiring unit, configured to acquire a value of the liquid crystal capacitor according to the dielectric constant of the liquid crystal capacitor;

a gamma reference voltage setting unit, configured to acquire a feedback voltage according to the value of the liquid crystal capacitor, acquire a second gamma reference voltage according to the feedback voltage, and update the first gamma reference voltage to the second gamma reference voltage;

wherein the apparatus for setting the gamma reference voltage further comprises:

a determining unit, configured to determine first gamma reference voltages corresponding to the different gray scales respectively; and a grouping unit, configured to group all the gray scales into different gray scale regions; and wherein the dielectric constant acquiring unit is configured to acquire, according to respective first gamma reference voltages corresponding to different gray scales within one of the gray scale regions, dielectric constants of the liquid crystal capacitor corresponding to the different gray scales respectively, and acquire an average of the dielectric constants in said gray scale region;

wherein the liquid crystal capacitance acquiring unit is configured to acquire the value of the liquid crystal capacitor corresponding to said gray scale region according to the average of the dielectric constants corresponding to said gray scale region.

11. The driving circuit according to claim 10, wherein the gamma reference voltage setting unit comprises:

a first acquiring module of feedback voltage, configured to acquire the feedback voltage for one of the gray scale regions according to the value of the liquid crystal capacitor corresponding to the gray scale region;

a first acquiring module of second gamma reference voltage, configured to acquire the second gamma reference voltage corresponding to the gray scale region according to the feedback voltage acquired by the first acquiring module for feedback voltage;

a first updating module, configured to update all the first gamma reference voltages within the gray scale region to the second gamma reference voltage according to the second gamma reference voltage acquired by the first acquiring module for feedback voltage.

12. The driving circuit according to claim 10, wherein the gamma reference voltage setting unit comprises:

a second acquiring module of feedback voltage, configured to acquire, according to respective values of the liquid crystal capacitor corresponding to the different gray scale regions, feedback voltages corresponding to the different gray scale regions respectively;

a determining module, configured to determine the gray scale regions to which the feedback voltages respectively belong;

a second acquiring module of second gamma reference voltage, configured to acquire second gamma reference voltages corresponding to the gray scale regions to which the feedback voltages respectively belong;

a second updating module, configured to update all the first gamma reference voltages within each of the gray scale regions to which the feedback voltages respectively belong as the respective second gamma reference voltage.

* * * * *

UNITED STATES PATENT AND TRADEMARK OFFICE

CERTIFICATE OF CORRECTION

PATENT NO. : 9,171,510 B2
APPLICATION NO. : 14/128733
DATED : October 27, 2015
INVENTOR(S) : You et al.

It is certified that error appears in the above-identified patent and that said Letters Patent is hereby corrected as shown below:

In the claims

Claim 4, col. 16, line 44, the symbol "ϵ" should read --ε--

Signed and Sealed this
Nineteenth Day of April, 2016

Michelle K. Lee

Michelle K. Lee
*Director of the United States Patent and Trademark Office*